US008552966B2

(12) United States Patent
Han et al.

(10) Patent No.: US 8,552,966 B2
(45) Date of Patent: Oct. 8, 2013

(54) APPARATUS AND METHOD FOR DISPLAYING DRIVE STATE OF BACKLIGHT IN LIQUID CRYSTAL DISPLAY DEVICE

(75) Inventors: Jae-Won Han, Deokeun-ri (KR); Jun-Hyeok Yang, Goyang Si (KR)

(73) Assignee: LG Display Co. Ltd., Seoul (KR)

( * ) Notice: Subject to any disclaimer, the term of this patent is extended or adjusted under 35 U.S.C. 154(b) by 681 days.

(21) Appl. No.: 12/277,820

(22) Filed: Nov. 25, 2008

(65) Prior Publication Data

US 2009/0189843 A1 Jul. 30, 2009

(30) Foreign Application Priority Data

Jan. 25, 2008 (KR) ..... 10-2008-0008186

(51) Int. Cl.
*G09G 3/38* (2006.01)

(52) U.S. Cl.
USPC ..... 345/102

(58) Field of Classification Search
USPC ..... 345/102
See application file for complete search history.

(56) References Cited

U.S. PATENT DOCUMENTS 6,002,215 A * 12/1999 Yamashita et al. ..... 315/308
6,504,311 B1 * 1/2003 Kumar et al. ..... 315/169.3
7,446,483 B2 * 11/2008 Nishinosono ..... 315/247
2006/0050048 A1 * 3/2006 Lee et al. ..... 345/102
2006/0087486 A1 * 4/2006 Lee ..... 345/102
2008/0316165 A1 * 12/2008 Kim et al. ..... 345/102

* cited by examiner

*Primary Examiner* — Chanh Nguyen
*Assistant Examiner* — Tsegaye Seyoum
(74) *Attorney, Agent, or Firm* — Brinks Hofer Gilson & Lione

(57) ABSTRACT

Disclosed is checking a drive state of a backlight lamp of a liquid crystal display device and notifying to an external entity whether it is normally driven in which level or is difficult to be normally driven. The apparatus for displaying a drive state of a backlight in a liquid crystal display device includes an inverter for converting an inputted DC voltage into an AC voltage of a certain level, and outputting the same to a backlight lamp; a drive voltage detecting unit for detecting a drive voltage supplied to the backlight lamp from the inverter and outputting a detected signal according to the detected drive voltage; a drive current detecting unit for detecting a tube current of the backlight lamp and outputting a detected signal according to the detected tube current; a drive voltage control/drive state signal output unit for checking a drive state of the backlight lamp based on the two detected signals, and controlling the drive voltage outputted from the inverter based on the checked result as well as outputting a drive state signal for indicating the drive state; and a lamp drive state indicating unit for indicating in which drive state the backlight lamp is driven according to the drive state signal.

8 Claims, 2 Drawing Sheets

APPARATUS AND METHOD FOR DISPLAYING DRIVE STATE OF BACKLIGHT IN LIQUID CRYSTAL DISPLAY DEVICE

BACKGROUND

1. Field of the Invention

The present invention relates to a method for displaying a drive state of a backlight in a liquid crystal display device, and more particularly, to an apparatus and method for displaying a drive state of a backlight in a liquid crystal display device which checks a drive state of a backlight lamp and notifies the checked result to an outside entity.

2. Description of the Related Art

With the rapid development in the field of information and technology, the importance of a flat panel display device for displaying a variety of information has recently increased. As a representative example of the flat panel display device, a liquid crystal display (LCD) device is an apparatus which displays an image using an optical anisotropy of a liquid crystal, and has many advantages including being small in size, thin in thickness, low in power consumption, high definition, and the like.

Since the liquid crystal display device does not have a self light-emitting characteristic, a backlight unit supplying light is required to implement an image. The backlight unit uses a Cold Cathode Fluorescent Lamp (CCFL) or an External Electrode Fluorescent Lamp (EEFL) as a light source. Light emitted from the CCFL or EEFL is transmitted through a light guide plate to be reflected onto a liquid crystal display screen directly below the liquid crystal display device.

The Cold Cathode Fluorescent Lamp (CCFL) and the External Electrode Fluorescent Lamp (EEFL) have similar characteristics to each other. Here, the EEFL does not have an electrode or a filament within a glass tube, instead, covers each outer wall of both ends of a lamp with a carbon or silver powder so as to use it as an electrode. For the EEFL, a condenser is provided in each lamp, thereby enabling distribution of a current when connecting the lamps in parallel. Thus, it has an advantage of using a plurality of lamps by connecting them in parallel to one inverter. The tube skin temperature in the EEFL is lower than that in the CCFL, which greatly reduces degradation of a frame or color change of a screen when an advertising signboard is manufactured.

However, the CCFL uses a relatively great amount of mercury which is environmentally regulated, and is connected to the inverter through a power line, thereby causing a leakage of a current. In addition, the CCFL has only 10,000~50,000 hours of lifetime, thereby being undesirable for use in a television. From the aspect of reliability, the CCFL is vulnerable to vibration or an impact, and from the aspect of color reproduction, visibility thereof is highly reduced when compared to a conventional a cathode ray tube (CRT).

Due to such reasons, a white LED or a color LED, which overcomes the demerits of the CCFL, has drawn much attention as a light emitting diode having high reliability, with advantages of high color reproduction, environmental-friendly characteristics, and long lifetime.

FIG. 1 is a block diagram of a backlight driving device of a related art liquid crystal display device. As shown in the drawing, the backlight driving device may include an inverter 11 for converting a DC voltage inputted from an external source into a boosted AC voltage and outputting the same to a backlight lamp (CCFL/EEFL) 12; the backlight lamp 12 lighted by the boosted AC voltage outputted from the inverter 11 and supplying a backlight to a liquid crystal panel; a drive voltage detecting unit 13 for detecting a drive voltage supplied to the backlight lamp 12 from the inverter 11, and outputting a detected signal DET1 according to the detected drive voltage to a protection circuit unit 15; a drive current detecting unit 14 for detecting a tube current of the backlight lamp 12 and outputting a detected signal DET2 according to the detected tube current to the protection circuit unit 15; and the protection circuit unit 15 for checking a drive state of the backlight lamp 12 based on the detected signals DET1 and DET2, and, if a voltage or a current greater than a predetermined allowable level is detected to be supplied, stopping the drive of the inverter 11 so as to turn off the backlight lamp 12.

A description of an operation of such components will now be given in detail. The inverter 11 is configured to convert the DC voltage inputted from power source into an AC voltage of a level high enough to light the backlight lamp 12, and to output the same to the backlight lamp 12.

The backlight lamp 12 is configured to supply light emitting by being lighted by the boosted AC voltage outputted from the inverter 11, as a backlight, to the liquid crystal panel of the liquid crystal display device. Here, the backlight lamp 12 is implemented as the Cold Cathode Fluorescent Lamp (CCFL) or the External Electrode Fluorescent Lamp (EEFL).

The drive voltage detecting unit 13 is configured to detect a level of the AC voltage supplied to the backlight lamp 12 from the inverter 11, and to output a detected voltage signal DET1 according to the detected level to the protection circuit unit 15.

The drive current detecting unit 14 is configured to detect the tube current of the backlight lamp 12, and to output a detected current signal DET2 according to the detected tube current to the protection circuit unit 15.

The protection circuit unit 15 is configured to check the drive state of the backlight lamp 12 based on the DET1 inputted from the drive voltage detecting unit 13 and the DET2 inputted from the drive current detecting unit 14, and to stop the drive of the inverter 11 if a voltage or a current greater than the predetermined allowable level is determined to be supplied.

The backlight lamp 12 is thusly turned off, thereby preventing the risk of a fire due to a high voltage as well as protecting an operator's safety.

In the backlight drive circuit of the related art liquid crystal display device, the protection circuit unit simply checks the voltage or the current supplied to the backlight lamp, and shuts down the lighting operation of the backlight lamp when it is determined that lighting is impossible due to overvoltage or overcurrent.

However, the protection circuit unit would malfunction if margins for electrically distinguishing a normal lamp from a defective lamp are insufficient, if the condenser of the protection circuit unit undergoes a characteristic change by temperature, or if characteristics of the lamp are changed due to a change in temperature at a periphery of the lamp or surroundings thereof. In this case, the lamp is unnecessarily turned off by the shutdown operation.

BRIEF SUMMARY

An apparatus for displaying a drive state of a backlight in a liquid crystal display device comprises: a backlight lamp lighted by a voltage outputted by a lamp drive device and supplying a backlight to a liquid crystal panel; a drive voltage detecting unit that detects a drive voltage supplied to the backlight lamp from the inverter, and outputs a detected signal according to the detected drive voltage; a drive current detecting unit that detects a tube current of the backlight lamp and outputs a detected signal according to the detected tube current; a drive voltage control/drive state signal output unit that checks a drive state of the backlight lamp based on the detected signals, and outputs a drive state signal according to the checked result; and a lamp drive state indicating unit that visually or audibly indicates by which drive state the backlight lamp is driven according to the drive state signal outputted from the drive voltage control/drive state signal output unit.

Also disclosed is a method for displaying a drive state of a backlight in a liquid crystal display device, comprising: detecting a drive voltage/drive current supplied to a backlight lamp from a lamp drive device and outputting each of detected signals thereof; checking a drive state of the backlight lamp based on the detected signals and outputting a drive state signal according to the checked result; and visually or audibly indicating by which drive state the backlight lamp is driven according to the drive state signal.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the present invention.

In the drawings.

DETAILED DESCRIPTION OF THE DRAWINGS AND THE PRESENTLY PREFERRED EMBODIMENTS

Description will now be given in detail of the preferred embodiments according to the present invention, examples of which are illustrated in the accompanying drawings.

Figure 1:
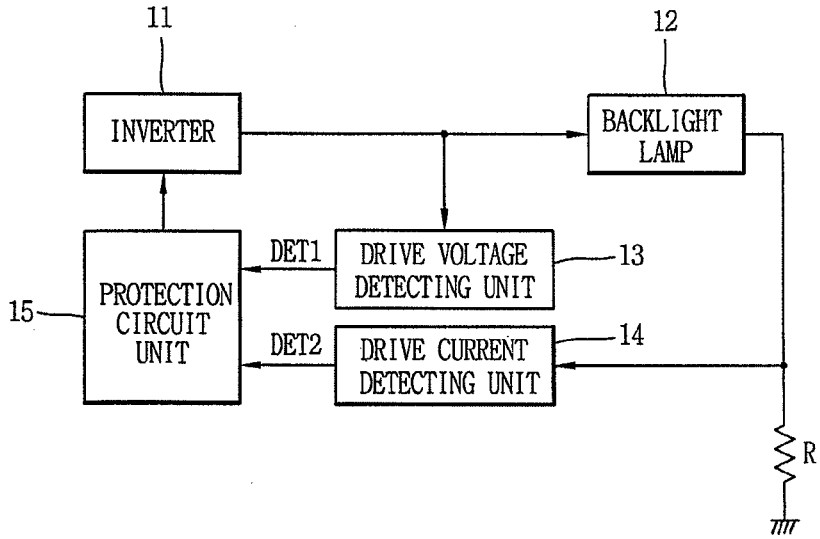
FIG. 1 is a block diagram illustrating a backlight drive device in a related art liquid crystal display device.
Figure 2:
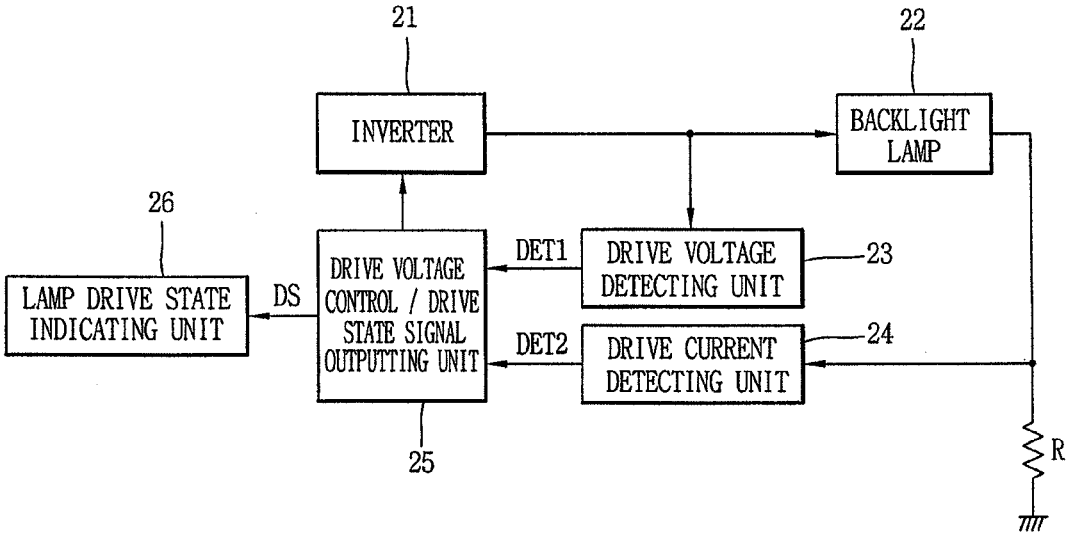
FIG. 2 is a block diagram illustrating an apparatus for displaying a drive state of a backlight in a liquid crystal display device according to a first embodiment of the present invention.

FIG. 2 is a block diagram illustrating an apparatus for displaying a drive state of a backlight in a liquid crystal display device according to a first embodiment of the present invention.

Referring to FIG. 2, the apparatus for displaying a drive state of a backlight in a liquid crystal display device may include: an inverter 21 that converts a DC voltage inputted from an external source into a boosted AC voltage, and outputs the same to a backlight lamp (CCFL/EEFL) 22. The backlight lamp 22 is lighted by the boosted AC voltage outputted from the inverter 21 and supplying a backlight to a liquid crystal panel. A drive voltage detecting unit 23 detects a drive voltage supplied to the backlight lamp 22 from the inverter 21, and outputs a detected signal DET1 according to the detected drive voltage. A drive current detecting unit 24 detects a tube current of the backlight lamp 22 and outputs a detected signal DET2 according to the detected tube current. A drive voltage control/drive state signal output unit 25 checks a drive state of the backlight lamp 22 based on the detected signals DET1 and DET2. If a voltage or a current greater than a predetermined allowable level is determined to be supplied, the drive voltage control/drive state signal output unit 25 controls the drive voltage level outputted from the inverter 21 below a certain level as well as outputs a drive state signal DS to indicate a drive state based on the checked result. A lamp drive state indicating unit 26 indicates by which level of a normal drive state the backlight lamp 22 is driven or the backlight lamp 22 is unable to be normally driven according to the drive state signal DS outputted from the drive voltage control/drive state signal output unit 25.

With such configuration, an operation according to the first embodiment of the present invention will be described in detail.

The inverter 21 is configured to convert a DC voltage inputted from power source into an AC voltage of a level appropriate to light the backlight lamp 22, and to output the same to the backlight lamp 22.

The backlight lamp 22 is configured to supply light emitting by being lighted by a boosted AC voltage outputted from the inverter 21, as a backlight, to the liquid crystal panel of the liquid crystal display device. Here, the backlight lamp 22 is implemented as the Cold Cathode Fluorescent Lamp (CCFL) or the External Electrode Fluorescent Lamp (EEFL).

The drive voltage detecting unit 23 is configured to detect a level of the AC voltage supplied to the backlight lamp 22 from the inverter 21, and to output a detected voltage signal DET1 according to the detected level to the drive voltage control/drive state signal output unit 25.

The drive current detecting unit 24 is configured to detect the tube current of the backlight lamp 22, and to output a detected current signal DET2 according to the detected tube current to the drive voltage control/drive state signal output unit 25.

The drive voltage control/drive state signal output unit 25 is configured to check the drive state of the backlight lamp 22 based on the DET1 outputted from the drive voltage detecting unit 23 and the DET2 outputted from the drive current detecting unit 24, and, if a voltage or a current greater than a predetermined allowable level is determined to be supplied, to control the level of a drive voltage outputted to the backlight lamp 22 from the inverter 21 below a predetermined level.

The drive voltage control/drive state signal output unit 25 is configured to determine the drive state of the backlight lamp 22 based on the detected signals DET1 and DET2, and to output a drive state signal DS according to the determined drive state.

The drive state signal DS may be outputted in several ways. For instance, if the drive state of the backlight lamp 22 is considered to be normal, the drive state signal DS is outputted at a frequency of 1~2 Hz. If the drive state is considered to have deviated from the normal state, the drive state signal DS is outputted at a higher frequency. If the drive state has deteriorated to the point that normal lighting is not possible, the drive state signal DS is outputted at a frequency of 100~200 Hz.

In such case, an indicator of the lamp drive state indicating unit 26, for instance, a light emitting diode flickers according to the drive state signal DS outputted from the drive voltage control/drive state signal output unit 25. That is, if the drive state of the backlight lamp 22 is considered to be normal, the light emitting diode flickers at a frequency of 1~2 Hz by the drive state signal DS. If the drive state is considered to have deviated from the normal state, the light emitting diode flickers at a higher frequency. Then, if the drive state has deteriorated to the point that normal lighting is not possible, the light emitting diode flickers at a frequency of 100~200 Hz.

Accordingly, a user may recognize a variety of drive states of the backlight lamp 22 based on flickering states (periods) of the light emitting diode of the lamp drive state indicating unit 26. For instance, the backlight lamp 22 may be in the absolutely normal state, not in the absolutely normal state but at a certain level within the normal state, and a state that normal lighting is not possible. When the backlight lamp 22 is recognized the state that normal lighting is not possible, the user may take an appropriate action, such as requesting maintenance and repair services, and the like.

If the flicking operation of the light emitting diode in the lamp drive state indicating unit 26 continues, the user may be irritated, causing eye fatigue. Preferably, it flickers shortly (e.g., several seconds) at an initial stage when the power is on.

In the above description, the light emitting diode has been described as the indicator of the lamp drive state indicating unit 26. Another example may include a pre-installed speaker, an additional speaker or a buzzer so as to indicate the drive state of the backlight lamp 22. In this case, the speaker or the buzzer generates an alarm sound based on the drive state signal DS outputted from the drive voltage control/drive state signal output unit 25. That is, if the drive state of the backlight lamp 22 is considered to be normal, an alarm sound is generated at a frequency of 1~2 Hz according to the drive state signal DS. As the drive state is considered to have deviated from the normal state, an alarm sound is generated at a higher frequency. Then, if the drive state of the backlight lamp 22 has deteriorated to the point that normal lighting is not possible, an alarm sound is generated at a frequency of 100~200 Hz.

To be certain, if the alarm sound of the speaker or the buzzer in the lamp drive state indicating unit 26 continues to be generated, the user may feel uncomfortable. Preferably, it sounds only for a short period of time (e.g., several seconds) at an initial stage when the power is on.

Figure 3:
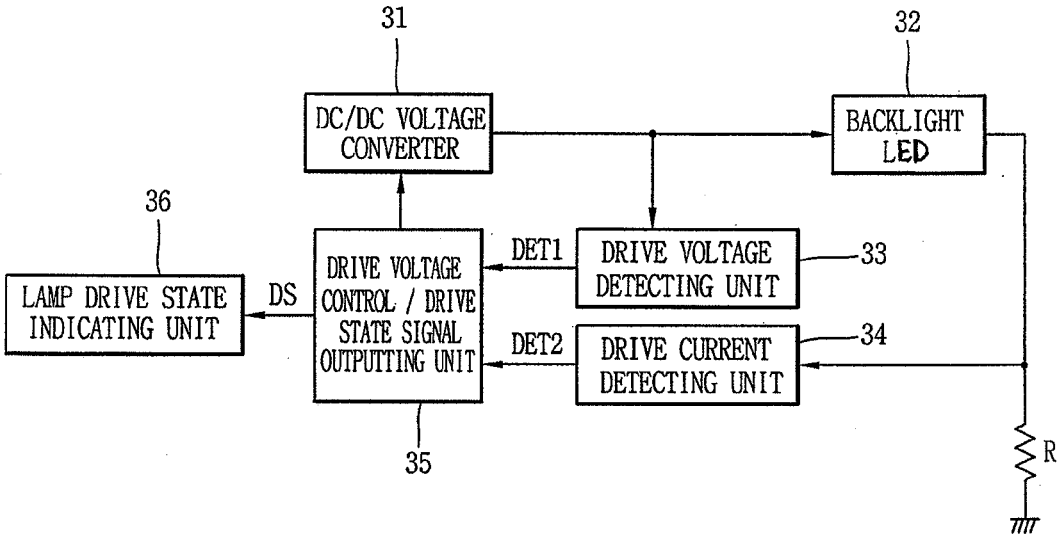
FIG. 3 is a block diagram illustrating an apparatus for displaying a drive state of a backlight in a liquid crystal display device according to a second embodiment of the present invention.

FIG. 3 is a block diagram illustrating an apparatus for displaying a drive state of a backlight in a liquid crystal display device according to a second embodiment of the present invention.

Referring to FIG. 3, the apparatus for displaying a drive state of a backlight in a liquid crystal display device may include a DC/DC voltage converter 31 that converts a DC voltage inputted from an external source into a boosted DC voltage, and outputs the same to a backlight LED 32. The backlight LED 32 is lighted by the boosted DC voltage outputted from the DC/DC voltage converter 31 and supplying a backlight to a liquid crystal panel. A drive voltage detecting unit 33 detects a drive voltage supplied to the backlight LED 32 from the DC/DC voltage converter 31, and outputs a detected signal DET1 according to the detected drive voltage. A drive current detecting unit 34 detects a drive current of the backlight LED 32 and outputs a detected signal DET2 according to the detected drive current. A drive voltage control/drive state signal output unit 35 checks a drive state of the backlight LED 32 based on the detected signals DET1 and DET2, and if a voltage or a current greater than a predetermined allowable level is determined to be supplied, controls the drive voltage level outputted from the DC/DC voltage converter 31 below a certain level as well as outputs a drive state signal DS for indicating a drive state based on the checked result. An LED drive state indicating unit 36 indicates at which level within the normal state the backlight LED 32 is driven or the backlight LED 32 is unable to be normally driven according to the drive state signal DS outputted from the drive voltage control/drive state signal output unit 35.

With such configuration, an operation according to the second embodiment of the present invention will be described in detail.

When the embodiments each described in FIGS. 2 and 3 are compared to each other, the backlight serving as a light source uses the backlight LED 32, instead of the Cold Cathode Fluorescent Lamp (CCFL) and the External Electrode Fluorescent Lamp (EEFL). Since the backlight LED 32 is driven by a relatively low DC voltage, the DC/DC voltage converter 31 is used, without requiring the inverter 21 as described in FIG. 2.

As described above, the backlight LED 32 is driven by a relatively low voltage, thereby preventing the risk of a fire even though a connection line of the backlight LED 32 is open.

However, from the aspect of protecting the components, it is preferable that the drive voltage control/drive state signal output unit 35 is configured to check the drive state of the backlight LED 32 based on the detected signal DET1 outputted from the drive voltage detecting unit 33 and the detected signal DET2 outputted from the drive current detecting unit 34, and to control the level of the drive voltage outputted to the backlight LED 32 from the DC/DC voltage converter 31 below a certain level if a voltage or a current greater than a predetermined allowable level is determined to be supplied.

The operations of the drive voltage control/drive state signal output unit 35 and the LED drive state indicating unit 36 for indicating at which level within the normal state the backlight LED 32 is driven or the backlight LED 32 is unable to be normally driven, are almost the same as those of the drive voltage control/drive state signal output unit 25 and the lamp drive state indicating unit 26 as described in FIG. 2.

The present invention has an effect of preventing a sudden shutdown by a malfunction of the protection circuit, by checking the drive state of the backlight lamp based on the drive voltage/drive current supplied to the backlight lamp, and indicating to an external entity that by which level of the normal state the backlight lamp is driven or it is unable to be normally driven.

In addition, the indicator is provided in the related art drive device, thereby not requiring an additional expense, thus to facilitate its implementation.

In addition, the drive state by which the backlight lamp is driven is indicated in various levels, thereby enabling an identification of such different drive states without using additional test equipment in a production stage as well as allowing the user to recognize the drive state of the backlight lamp in advance and take an appropriate action when needed.

The foregoing embodiments and examples are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

The invention claimed is:

1. An apparatus for displaying a drive state of a backlight in a liquid crystal display device, comprising:

an inverter that converts an inputted DC voltage into an AC voltage of a certain level, and outputs the same to a backlight lamp;

a drive voltage detecting unit that detects a drive voltage supplied to the backlight lamp from the inverter, and outputs a detected signal according to the detected drive voltage;

a drive current detecting unit that detects a tube current of the backlight lamp and outputs a detected signal according to the detected tube current;

a drive voltage control/drive state signal output unit that checks a drive state of the backlight lamp based on the two detected signals, and controls the drive voltage outputted from the inverter based on the checked result as well as outputs a drive state signal having a frequency for indicating the drive state; and a lamp drive state indicating unit that indicates in which drive state the backlight lamp is driven according to the drive state signal, wherein the drive voltage control/drive state signal output unit is configured to control the level of the drive voltage based on the two detected signals, and if a voltage or a current greater than a predetermined allowable level is determined to be supplied, to control the level of the drive voltage outputted to the backlight lamp from the inverter so as to be below a predetermined level;

wherein the lamp drive state indicating unit includes a light emitting diode that indicates a variety of drives states of the backlight lamp based on flickering states in response to the frequency to a user; and wherein the lamp drive state indicating unit performs an operation to indicate in which drive state the backlight lamp is driven based on the flickering states shortly for several seconds only at an initial stage when the power is on.

2. The apparatus of claim 1, wherein the backlight lamp is one of a Cold Cathode Fluorescent Lamp (CCFL) or an External Electrode Fluorescent Lamp (EEFL).

3. The apparatus of claim 1, wherein the drive voltage control/drive state signal output unit is configured such that if the drive state of the backlight lamp is considered to be normal, the drive state signal is outputted at a frequency of 1~2 Hz, if the drive state is considered to have deviated from the normal state, the drive state signal is outputted at a higher frequency, and if the drive state has deteriorated to the point that normal lighting is not possible, the drive state signal is outputted at a frequency of 100~200 Hz.

4. The apparatus of claim 1, wherein the lamp drive state indicating unit includes a light emitting diode (LED).

5. The apparatus of claim 1, wherein the lamp drive state indicating unit includes a speaker or a buzzer.

6. A method for displaying a drive state of a backlight in a liquid crystal display device, comprising:

a first step of detecting a drive voltage/drive current supplied to a backlight lamp from a lamp drive device, and outputting each of detected signals thereof;

a second step of checking a drive state of the backlight lamp based on the detected signals, and outputting a drive state signal having a frequency according to the checked result, the second step including controlling the level of the drive voltage based on the detected signals, and if a voltage or a current greater than a predetermined allowable level is determined to be supplied, controlling the level of the drive voltage outputted to the backlight lamp from the inverter so as to be below a predetermined level;

a third step of visually or audibly indicating in which drive state the backlight lamp is driven according to the drive state signal, the third step including indicating visually the drive state of the backlight lamp based on flickering states by using a light emitting diode in response to the frequency to a user shortly for several seconds only at an initial stage when the power is on, and audibly indicating the drive state based on the flickering state of the backlight lamp by using a speaker or a buzzer.

7. The method of claim 6, wherein the backlight lamp includes one of a Cold Cathode Fluorescent Lamp (CCFL), an External Electrode Fluorescent Lamp (EEFL) and a light emitting diode (LED).

8. The method of claim 6, wherein the second step further comprises:

outputting the drive state signal at a frequency of 1~2 Hz if the drive state of the backlight lamp is considered to be normal, outputting the drive state signal at a higher frequency if the drive state is considered to have deviated from the normal state, and outputting the drive state signal at a frequency of 100~200 Hz if the drive state has deteriorated to the point that normal lighting is not possible.

* * * * *